US011477552B1

(12) United States Patent
Leonard

(10) Patent No.: US 11,477,552 B1
(45) Date of Patent: Oct. 18, 2022

(54) HANGER APPARATUS THAT AUTOMATICALLY SLEEPS AND WAKES SMART HEADPHONE SYSTEM

(71) Applicant: Andrew William Benson Leonard, Santa Rosa, CA (US)

(72) Inventor: Andrew William Benson Leonard, Santa Rosa, CA (US)

( * ) Notice: Subject to any disclaimer, the term of this patent is extended or adjusted under 35 U.S.C. 154(b) by 63 days.

(21) Appl. No.: 17/237,955

(22) Filed: Apr. 22, 2021

Related U.S. Application Data

(60) Provisional application No. 63/148,062, filed on Feb. 10, 2021.

(51) Int. Cl.
*H04R 1/02* (2006.01)
*H04R 5/033* (2006.01)
*H04R 1/10* (2006.01)

(52) U.S. Cl.
CPC ..... *H04R 1/026* (2013.01); *H04R 1/1008* (2013.01); *H04R 1/1041* (2013.01); *H04R 5/033* (2013.01)

(58) Field of Classification Search
CPC .... H04R 1/026; H04R 1/1008; H04R 1/1041; H04R 5/033
See application file for complete search history.

(56) References Cited

U.S. PATENT DOCUMENTS

2013/0066636 A1* 3/2013 Singhal ..... H04B 1/385 381/385
2016/0316181 A1* 10/2016 Hamra ..... H04N 7/185

FOREIGN PATENT DOCUMENTS

CN 213342639 * 6/2021

* cited by examiner

*Primary Examiner* — Tuan D Nguyen
(74) *Attorney, Agent, or Firm* — Plager Schack LLP; Mark H. Plager; Alexis J. Saenz

(57) ABSTRACT

An apparatus provides a quick and easy way too store smart headphones while preserving headphone battery life. A trigger element such as a magnet is positioned so that a sleep/wake system in the headphones detects its proximity when stored on the apparatus. In an exemplary embodiment, the apparatus is configured so that the headphones are hung in an open-air setting which makes them easily accessible for use without having to be retrieved from a closed container. When mounted, the trigger element may signal the headphones to enter a sleep mode to preserve battery life. Once removed, the headphones may detect the lack of proximity to the trigger element which frees the headphones for operation.

8 Claims, 4 Drawing Sheets

HANGER APPARATUS THAT AUTOMATICALLY SLEEPS AND WAKES SMART HEADPHONE SYSTEM

CROSS-REFERENCE TO RELATED APPLICATIONS

This application claims benefit under 35 U.S.C. § 119(e) of U.S. Provisional Application having Ser. No. 63/148,062 filed Feb. 10, 2021, which is hereby incorporated by reference herein in its entirety.

BACKGROUND

The embodiments herein relate generally to electrical device accessories, and more particularly, to a hanger apparatus that automatically sleeps and wakes smart headphone system.

Some smart headphones today come with their own case that detects when the headphone is stored and thus not in use. When not stored in the dedicated case, the headphones are susceptible to inadvertent power events which drain the headphone's battery. Many users find it inconvenient to store and remove the headphones from enclosures such as the case and instead leave the headphones laying around (for example, on a table). The headphones may be paired to another device. When the other device engages in use, the headphones may detect the activity and toggle on operation, which causes the battery to drain.

As can be seen, there is a need for an apparatus that provides users with easy access to smart headphones while protecting the headphone's battery from draining accidently.

SUMMARY

In one aspect of the subject technology, a hanger apparatus is disclosed that automatically sleeps and wakes a smart headphone system. The apparatus comprises a resting mount configured to detain a pair of smart headphones; and a trigger element coupled to the resting mount and positioned so that a sensory element in the pair of headphones detects when the trigger element is in proximity and automatically places the headphones in a sleep state.

BRIEF DESCRIPTION OF THE FIGURES

The detailed description of some embodiments of the present invention is made below with reference to the accompanying figures, wherein like numerals represent corresponding parts of the figures.

DETAILED DESCRIPTION OF CERTAIN EMBODIMENTS

Figure 1:
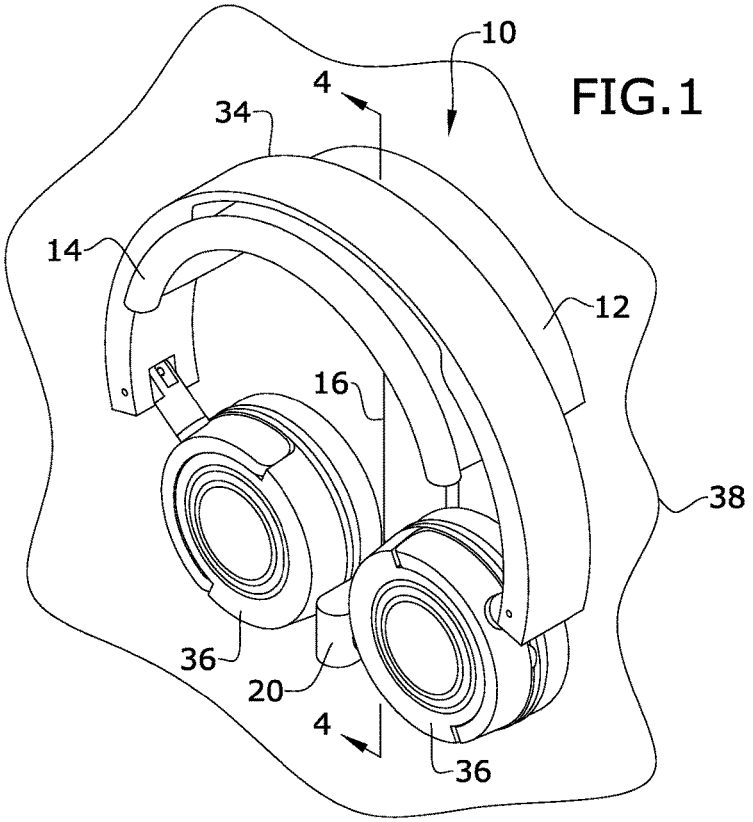
FIG. 1 is a perspective top view of a hanger apparatus configured to automatically put to sleep and wake a smart headphone system according to an exemplary embodiment of the subject technology.
Figure 2:
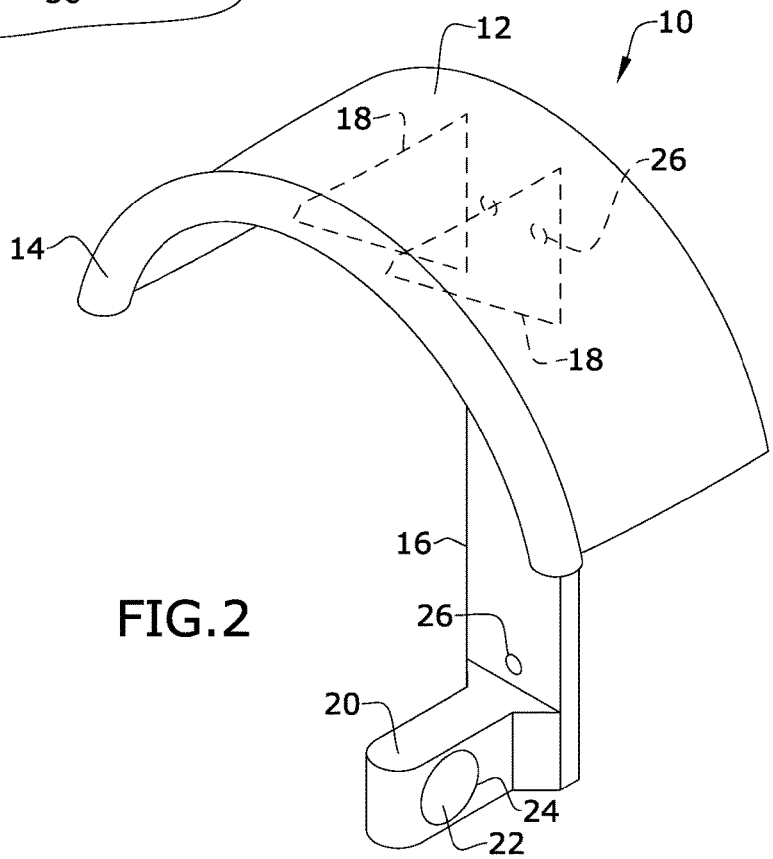
FIG. 2 is a perspective top view of the apparatus of FIG. 1 without the smart headphone system mounted and showing shadow views of support elements.

The word "exemplary" is used herein to mean "serving as an example or illustration." Any aspect or design described herein as "exemplary" is not necessarily to be construed as preferred or advantageous over other aspects or designs.

By way of example, and referring to the Figures, embodiments disclosed generally provide a hanger apparatus 10 (herein referred to generally as the "apparatus 10") configured to automatically put to sleep and wake a smart headphone system 34. The apparatus 10 allows the user to hang their smart headphones 34 on a wall (or other mounting surface) 38 for ease of access. As some will appreciate, the apparatus 10 also allows one to showcase their smart headphones 34 which may have an aesthetic appearance when displayed out in the open.

The apparatus 10 generally comprises a frame that may include a top, rounded resting mount 12 generally indexed to the curve of a headphone headband. In some embodiments, the resting mount 12 may include a front lip 14 extending from end-to-end along the front edge of the resting mount 12. The apparatus 10 may further include a brace or spine 16 coupled to the resting mount 12. Proximate an end of the brace 16 may be a trigger element 22 which is recognized by the sleep/wake mechanism (not shown) of the smart headphone system 34. The structure supporting the trigger element 22 may generally project downward away from the resting mount 12.

The trigger element 22 may be based on a passive or active element. For example, some smart headphones use a sensor which detects a magnetic field (or other sensory input). In an exemplary embodiment, the trigger element may comprise one (or a pair of) magnet(s) (sometimes referred to interchangeably as the "trigger element 22" or "magnet(s) 22"). The magnet(s) 22 may be housed within a well 24 in a flange 20 that projects outward from the bottom end of the spine 16. When the speaker earcups 36 are positioned on the apparatus 10 below the resting mount 12, the speakers in the earcups 36 may be disposed to surround the magnet 22 (for example, on opposite sides of the spine 16 and magnet 22) which is in a position for the smart headphone system 34 to detect the magnet's 22 proximity. An internal circuit in the smart headphone system 34 detects the presence of the magnet 22 which may trigger the smart headphone system 34 to automatically enter a sleep mode, thus conserving power usage. The user may then easily remove the smart headphones 34 from the apparatus 10 at will without having to unlock or unzip any storage enclosures. Removal of the smart headphones 34 from the apparatus 10 will displace the speakers from the trigger element 22 which in some embodiments may automatically wake the headphones from a sleep mode.

Figure 3:
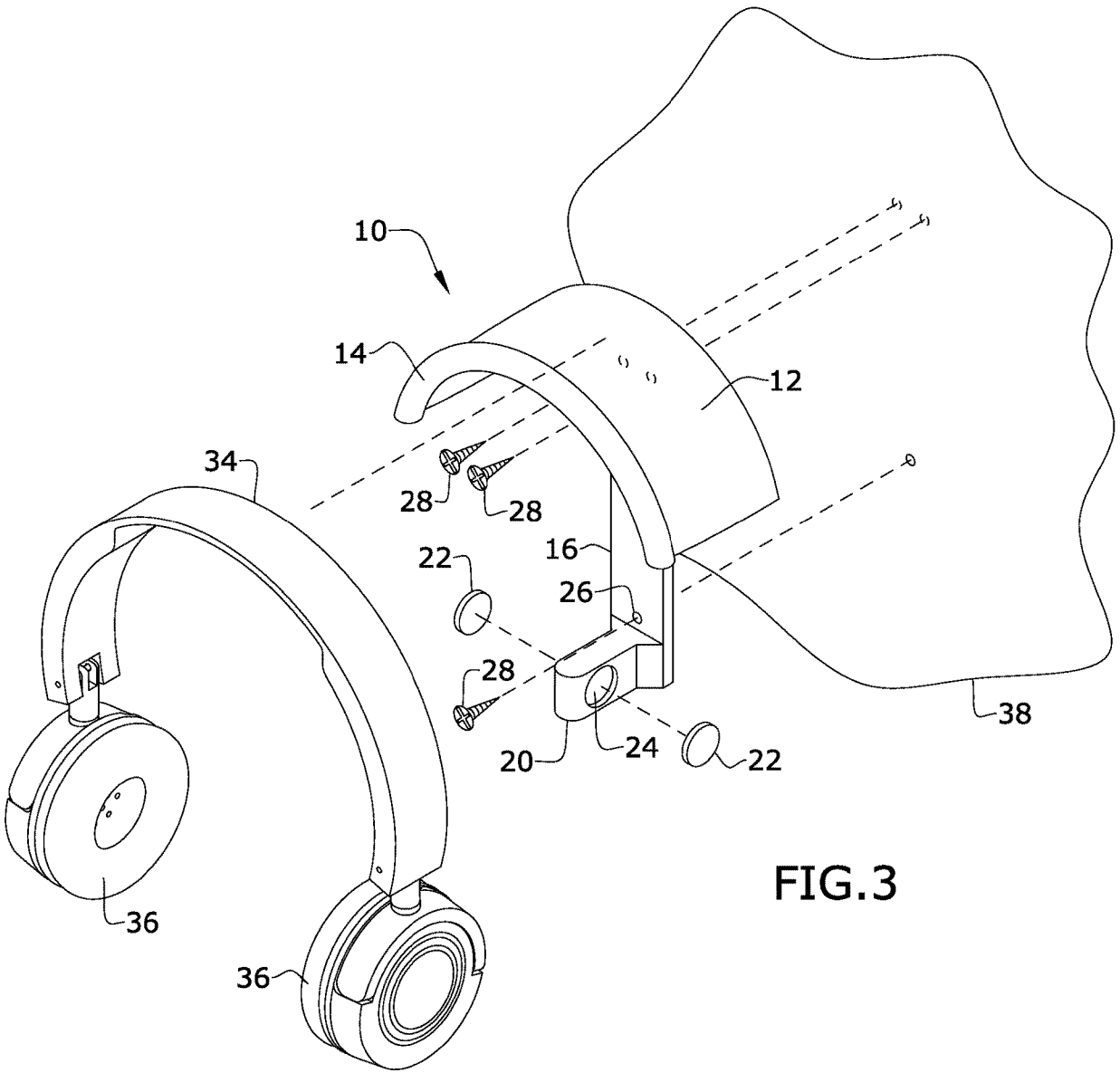
FIG. 3 is an exploded view of the apparatus of FIG. 2.
Figure 4:
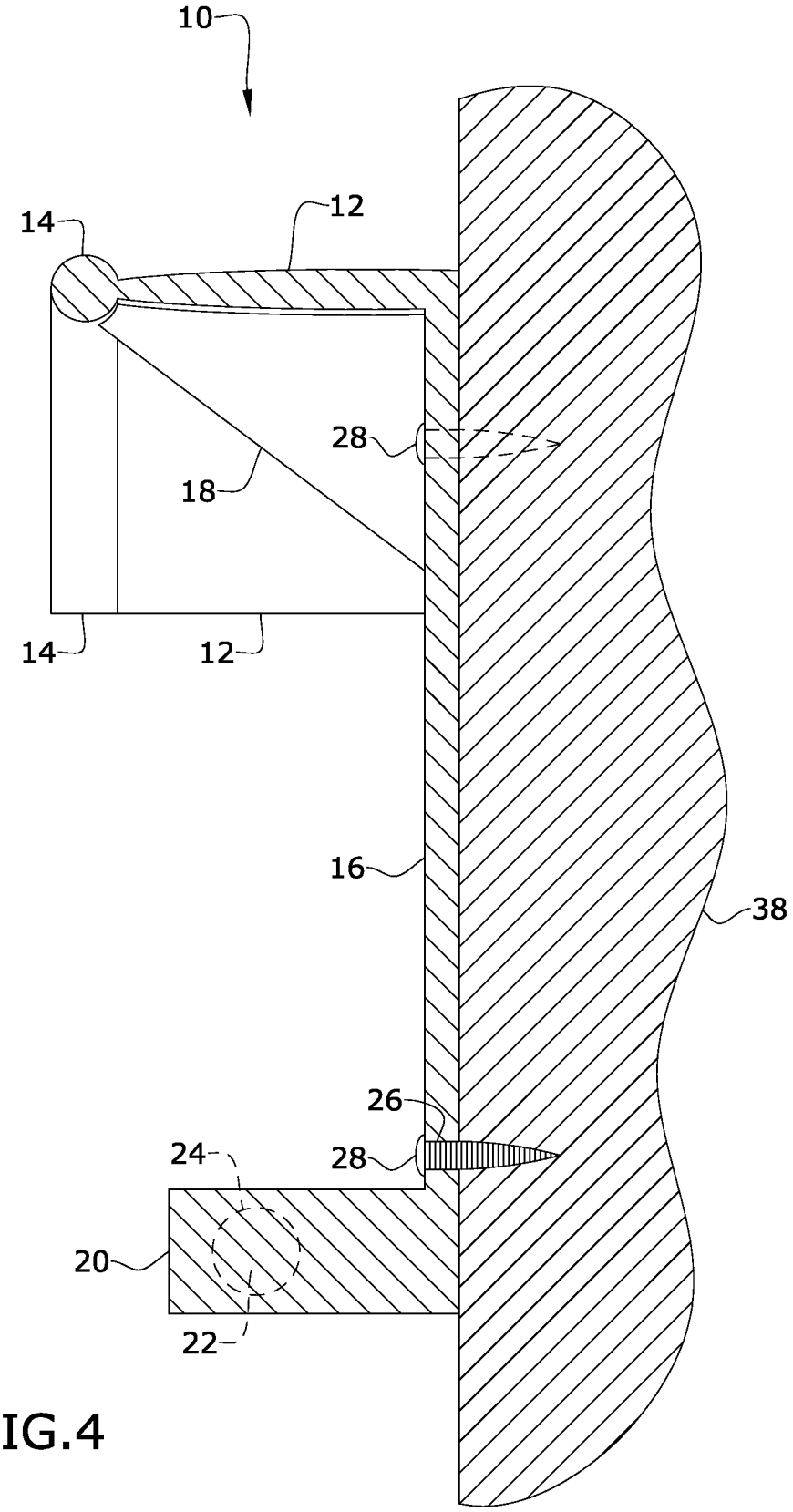
FIG. 4 is a cross-sectional view taken along the line 4-4 of FIG. 1.
Figure 5:
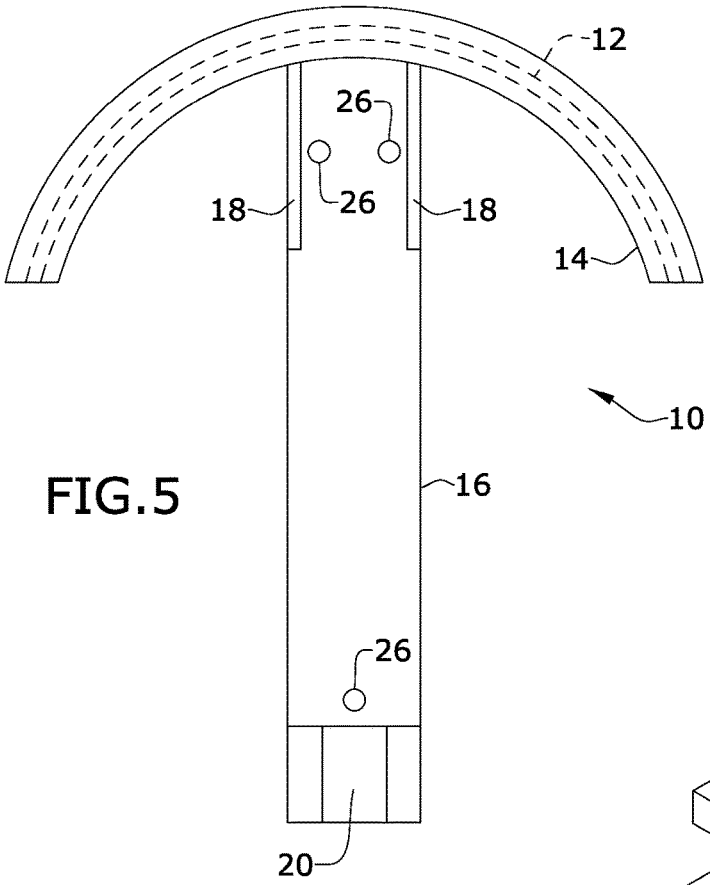
FIG. 5 is a front view of the apparatus of FIG. 1.

As shown In FIGS. 3-5, the apparatus 10 may be mounted onto the wall 38 by attaching brackets 18 onto the wall 38 and/or using fasteners 28 (for example, screws) through holes 26 in the spine 16 to secure the spine 16 against the wall 38.

Figure 6:
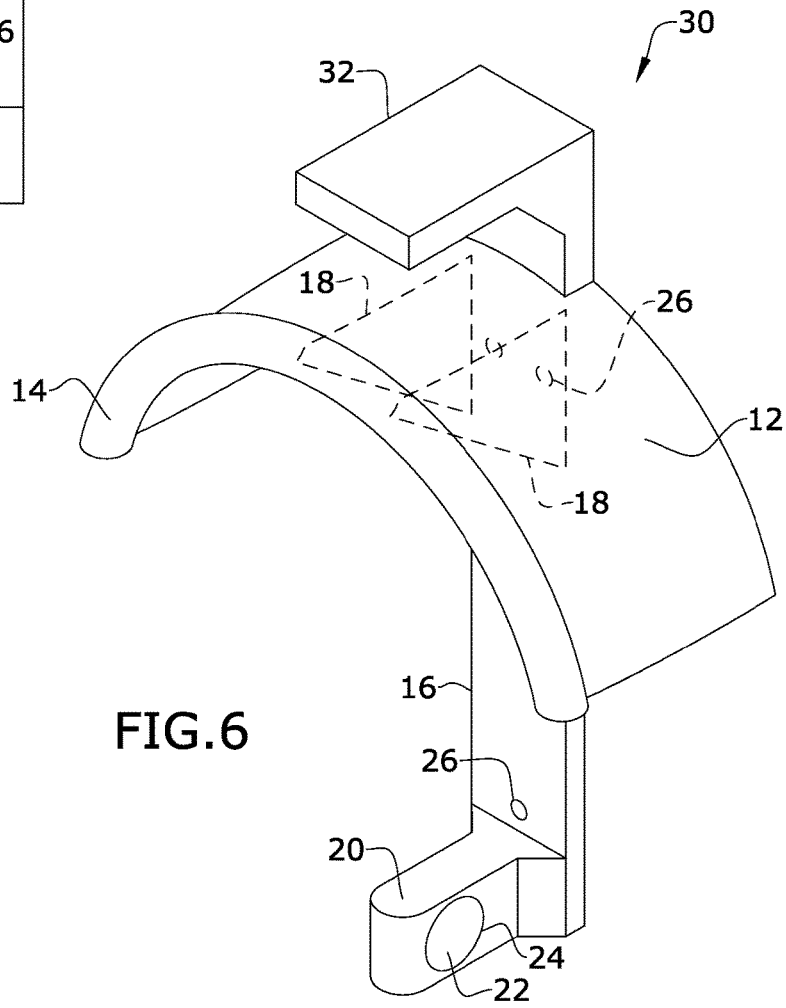
FIG. 6 is a perspective top view of a hanger apparatus in accordance with an alternate embodiment of the subject technology.

Referring now to FIG. 6, an apparatus 30 is shown according to another embodiment. The apparatus 30 is similar to the apparatus 10 except that the apparatus 30 may be configured to operate as a stand (which may be in addition to a wall mounted fixture) which may be supported by an underlying structure such as a table, shelf or the like. The apparatus 30 may include a projection 32 (for example, a hook, a catch, or a flange) on a top end of the spine 16 that projects perpendicularly away from the spine 16. The projection 32 may be configured so that a nook is defined between the bottom surface of the projection 32 and the top surface of the resting mount 12 to prevent the smart headphones 34 from slipping off the apparatus 30. The apparats 30 may be configured to maintain its balance when used as a stand and when holding the smart headphones 34 on the resting mount 12. For example, the bottom end of the spine 16 may be enlarged with a bigger footprint to prevent the apparatus 30 from falling over.

In some embodiments, the projection 32 may project in the opposite direction shown which may be more suitable for some hanging or stand applications depending on structure of the furniture available. As mentioned previously, the apparatus 30 allows for the smart headphones 34 to be on full display so that others may appreciate the aesthetic design and yet allows the user to quickly remove the headphones for use while also being confident that the headphones will be ready to use with sufficient power since they are asleep when hung and not inadvertently draining power.

Persons of ordinary skill in the art may appreciate that numerous design configurations may be possible to enjoy the functional benefits of the inventive systems. For example, the resting mount may not necessarily be round and may be substituted with other surface shapes (for example, a hook or flat platform), without departing from the inventiveness of the subject technology. In addition, the apparatus may not necessarily be a one-piece unit as shown but may comprise a system that includes the mount and a detached support for the trigger element repositionable where the earcups will be positioned when hung. Still yet, the brace may be telescopic to accommodate for headphones with earcups that may have a variable distance from the mount so, that the trigger element may be repositionable within the necessary proximity to the headphone's detection element. Thus, given the wide variety of configurations and arrangements of embodiments of the present invention the scope of the present invention is reflected by the breadth of the claims below rather than narrowed by the embodiments described above.

What is claimed is:

1. A hanger apparatus configured to automatically put to sleep and wake a smart headphone system, comprising:

a resting mount configured to detain a pair of smart headphones; and a trigger element coupled to the resting mount and positioned so that a sensory element in the pair of headphones detects when the trigger element is in proximity and automatically places the headphones in a sleep state.

2. The apparatus of claim 1, wherein the trigger element is a magnet on a frame of the apparatus and positioned within proximity of detection by the sensory element when the pair of smart headphones are detained on the resting mount.

3. The apparatus of claim 2, wherein the magnet is in a position on the frame wherein speakers of the smart headphones surround the magnet on opposite sides of the magnet.

4. The apparatus of claim 1, wherein the resting mount is curved to index a curvature of a headphone band of the pair of smart headphones.

5. The apparatus of claim 1, further comprising a front lip on the resting mount.

6. The apparatus of claim 1, further comprising:

a spine connecting the resting mount to the trigger element, wherein the trigger element is positioned below the resting mount and the trigger element is proximate a bottom end of the spine.

7. The apparatus of claim 1, further comprising:

a projection extending perpendicular from the spine, and wherein the projection is positioned above the resting mount.

8. The apparatus of claim 1, further comprising:

a flange on a bottom end of the frame, wherein the trigger element is positioned in the flange and disposed so that speakers of the smart headphones surround the flange on opposite sides of the flange.

* * * * *